US005376027A

United States Patent [19]

Hergenrather

[11] Patent Number: 5,376,027

[45] Date of Patent: Dec. 27, 1994

[54] MARINE PROPULSION MECHANISM FOR WATER CRAFT

[76] Inventor: Joseph J. Hergenrather, 909 Chesapeake Dr., Stevensville, Md. 21666

[21] Appl. No.: 210,474

[22] Filed: Mar. 21, 1994

[51] Int. Cl.[5] ..... B63H 11/00

[52] U.S. Cl. ..... 440/38; 440/6; 440/40; 440/900

[58] Field of Search ..... 114/151; 440/6, 7, 38, 440/40, 41, 42, 900

[56] References Cited

U.S. PATENT DOCUMENTS

| | | | |
|---|---|---|---|
| 3,338,169 | 8/1967 | Kinney | 440/40 |
| 3,703,642 | 11/1972 | Balaguer | 440/6 |
| 3,995,579 | 12/1976 | Childre . | |
| 4,114,074 | 9/1978 | Stewart et al. | 318/257 |
| 4,587,388 | 5/1986 | Cavin | 200/86.5 |
| 4,728,307 | 3/1988 | Burgess | 440/7 |
| 4,931,026 | 6/1990 | Woodland | 440/38 |

*Primary Examiner*—Jesus D. Sotelo
*Attorney, Agent, or Firm*—Rhodes & Ascolillo

[57] ABSTRACT

A marine propulsion mechanism submersible in water for driving a water craft is disclosed. The propulsion mechanism includes a streamlined housing having a fluid inlet opening positioned between the forward and rearward ends of the housing in addition to a fluid discharge opening at the rearward end. A tubular support is joined to the housing for mounting such upon a water craft. An inlet scoop extends outwardly from the housing and directs water to the fluid inlet opening. The scoop is provided with a rigid tube having a first end secured about the fluid inlet opening and a second end terminating at forwardly directed duct remote from the exterior surface of the housing. The scoop further includes a screen set within the forwardly directed duct for preventing debris from entering the housing interior. An impeller is rotationally secured within the housing adjacent the fluid inlet opening. Rotation of the impeller draws water through the inlet opening and discharges it through the outlet with jet-like force. In the principal embodiment of the invention, a geared transmission is secured within the housing for transmitting the energy of an above-board electric motor to a pair of impellers. In a second embodiment of the invention, an electric motor unit is positioned within the housing for rotating a single impeller.

7 Claims, 4 Drawing Sheets

MARINE PROPULSION MECHANISM FOR WATER CRAFT

FIELD OF THE INVENTION

The present invention relates generally to marine propulsion systems and, more particularly, to a jet drive mechanism including a pivoted housing for directional control purposes.

BACKGROUND OF THE INVENTION

It has become a common practice to employ a battery operated electric motor to propel a small fishing boat at relatively low speeds for trolling or movement while casting. These motors are particularly well suited for bass fishing and can also be used as an auxiliary power source in the event that the boat's more powerful outboard motor becomes disabled. While many electric motors have been proposed in the prior art, all appear to be characterized by inadequacies which render them less than fully satisfactory for their intended purposes.

When trolling or casting from a small boat, the operator frequently desires to move at relatively slow speeds at distances very near to the shoreline and in shallow water. These areas are often choked by floating vegetation and submerged weeds which are significant fish habitats. To enter such areas with a boat propelled by an electric motor having the usual, exposed propeller arrangement is an invitation for trouble as the propeller blades often become entangled in vegetation. Once entangled, much time and effort is often expended clearing the debris from the propeller to allow for the continued forward motion of the boat rather than fishing. In light of the foregoing problem, a need has arisen for a "weedless" drive mechanism for marine vehicles capable of delivering a relatively high thrust from an electric motor.

SUMMARY OF THE INVENTION

Accordingly, it is a principal object of the present invention to provide a marine propulsion mechanism submersible in water for a water craft with a motor-driven impeller disposed within a streamlined housing into which water may be delivered by an outwardly extending inlet scoop.

Another object of the present invention is to provide a marine propulsion mechanism of the type described wherein the inlet scoop includes a rigid tube having a first end secured to the housing and a removable screen set within the tube for preventing weeds and debris from entering the housing.

The present invention achieves the above objects, among others, by providing in one aspect a marine propulsion mechanism submersible in water for driving a water craft. It includes a streamlined housing having forward and rearward ends adapted for mounting beneath a water craft, with the housing including a fluid inlet opening positioned between the forward and rearward ends and a fluid discharge opening at the rearward end. An inlet scoop extends outwardly from the housing for directing water to the fluid inlet opening, and a first impeller is rotationally secured within the housing adjacent the fluid inlet opening. There is also a first rotary mechanism for rotating the first impeller.

Preferably, the scoop further includes a rigid tube having a first end secured about the fluid inlet opening and a second end terminating at forwardly directed duct remote from the housing, as well as a screen set within the forwardly directed duct for preventing debris from entering the housing.

The first rotary mechanism for rotating the first impeller includes an electric motor unit positioned within the housing and has an impeller shaft extending rearwardly therefrom for carrying the impeller. Further, a tubular support is joined to the housing for mounting it upon a water craft. There is also a geared transmission, which includes a vertically disposed drive shaft secured for rotation about its longitudinal axis within the tubular support. A primary bevel gear is secured to the bottom of the drive shaft, with a secondary bevel gear engaging the primary bevel gear. Next, a horizontally disposed lateral shaft is secured to the secondary bevel gear for rotation therewith, and a tertiary bevel gear fixed upon the lateral shaft, at a distance remote from the secondary bevel gear, for rotation therewith. Finally, there is an impeller bevel gear engaged with the tertiary bevel gear, and a horizontally disposed impeller shaft secured to the impeller bevel gear for rotation therewith, with the impeller shaft carrying the impeller.

Preferably, the marine propulsion mechanism, further includes a second impeller rotationally secured within the housing and a second rotary mechanism for rotating the second impeller. The housing has a pair of laterally spaced lobes joined together by a bridge portion, with each of the lobes enshrouding one of the impellers. The fluid inlet in one of the lobes and the inlet scoop extends outwardly from the same lobe. Also, there is a second fluid inlet in the other lobe, and a second inlet scoop extending outwardly from the other lobe for directing water to the second fluid inlet. The bridge portion is secured to the bottom of the tubular support.

Preferably, a guide bevel gear is freewheeling upon the lateral shaft and engages the impeller bevel gear to hold it fast against the tertiary bevel gear. The second rotary mechanism for rotating the second impeller includes a geared transmission, which has a vertically disposed drive shaft secured for rotation about its longitudinal axis within the tubular support. A primary bevel gear is secured to the bottom of the drive shaft, with a first secondary bevel gear engaging the primary bevel gear. There is also a second secondary bevel gear which is engaged with the primary bevel gear. Additionally, a first horizontally disposed lateral shaft is secured to the first secondary bevel gear for rotation therewith, as a second horizontally disposed lateral shaft is secured to the second secondary bevel gear for rotation therewith. There is a first tertiary bevel gear fixed upon the first lateral shaft, at a distance remote from the first secondary bevel gear, for rotation therewith. A second tertiary bevel gear is fixed upon the second lateral shaft, at a distance remote from the second secondary bevel gear, for rotation therewith. A first impeller bevel gear is engaged with the first tertiary bevel gear, and a second impeller bevel gear is engaged with the second tertiary bevel gear. Finally, a first horizontally disposed impeller shaft is secured to the first impeller bevel gear for rotation therewith and carrying the impeller, and a second horizontally disposed impeller shaft is secured to the second impeller bevel gear for rotation therewith and carrying the second impeller.

In another aspect, the invention generally features a marine propulsion mechanism submersible in water for driving a water craft. It includes a streamlined housing having forward and rearward ends adapted for mounting upon a water craft. The housing also has a fluid inlet opening positioned between the forward and rearward ends with a fluid discharge opening at the rearward end. A tubular support is joined to the housing for mounting it upon a water craft, while an inlet scoop extends outwardly from the housing for directing water to the fluid inlet opening. The scoop includes a rigid tube having a first end secured about the fluid inlet opening and a second end terminating at a forwardly directed duct remote from the housing. The scoop also has a screen set within the forwardly directed duct for preventing debris from entering the housing. Finally, an impeller is rotationally secured within the housing adjacent the fluid inlet opening, and an electric motor unit is positioned within the housing and has an impeller shaft extending rearwardly therefrom for carrying the impeller.

These and other objects of the present invention will become readily apparent upon further review of the following specification and drawings.

BRIEF DESCRIPTION OF THE DRAWINGS

The present invention may be more readily described with reference to the accompanying drawings, in which.

DETAILED DESCRIPTION OF THE PREFERRED EMBODIMENT

Figure 5:
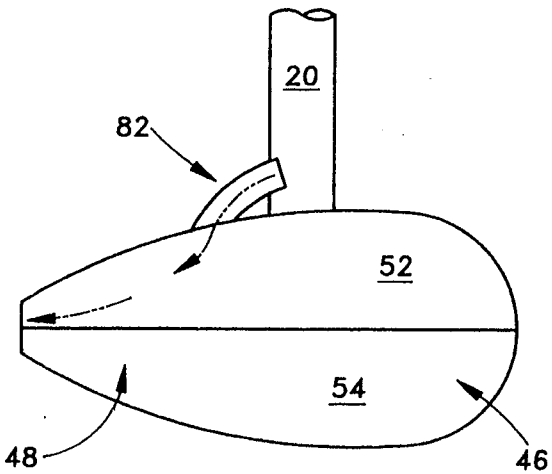
FIG. 5 is a side elevational view of the marine propulsion mechanism, arrows illustrating the direction of fluid flow into, and through, the housing during impeller rotation in a forward sense.

Referring now to the figures, a marine propulsion mechanism submersible in water for driving water craft in accordance with the present invention is illustrated. As shown, the marine propulsion mechanism 10 includes a pair of laterally spaced impellers 12 and 14 which are rotated by a geared transmission indicated generally at 16. The impellers 12 and 14, as well as the transmission 16, are disposed within a streamlined housing 18 which, in use, is suspended beneath the water's surface at the aft end of a boat (not shown) by a tubular support 20 (FIG. 5). The tubular support 20 may be pivoted about its longitudinal axis by the operator who, for directional control purposes, may selectively direct the thrust from the impellers either to the starboard or port side of the water craft.

Rotational movement is imparted to the impellers 12 and 14 by drive shaft 22. The drive shaft 22 is vertically disposed within the tubular support 20 and is coupled at its upper end to an above-board electric motor (not shown) for rotation about its longitudinal axis in the usual manner. At its lower end, the drive shaft 22 is coupled to the geared transmission 16 which converts rotational motion about a single vertical axis to rotational motion about two horizontal axes.

Figure 1:
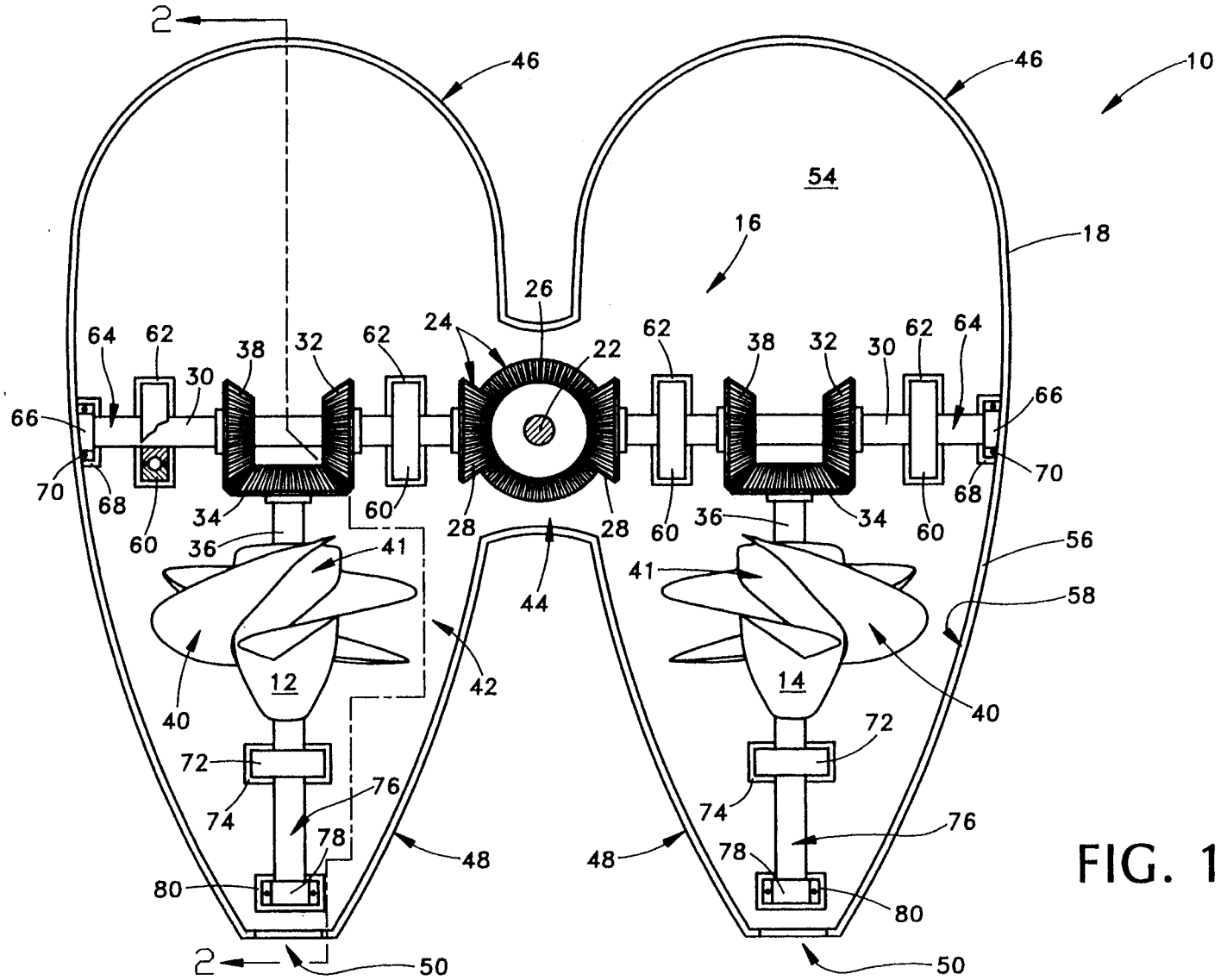
FIG. 1 is a top view of a marine propulsion mechanism for water craft in accordance with the present invention. The top portion of the housing has been removed to show the transmission and impellers.

The transmission 16 includes a number of gears each having interlocking teeth as at 24 for transmitting the power from the revolutions of the drive shaft 22 to the impellers 12 and 14. As is readily apparent from an examination of FIG. 1, rotational motion of the primary bevel gear 26, fixed to the bottom of drive shaft 22, is imparted to two secondary bevel gears 28 which engage the primary bevel gear 26 and ride thereon. Torque is transmitted from each secondary bevel gear 28 through a lateral shaft 30 to a tertiary bevel gear 32 which, in turn, rotates an impeller bevel gear 34. Since each impeller bevel gear 34 is fixed upon the forward end of an impeller shaft 36, the impeller shafts are subsequently rotated therewith. A guide bevel gear 38, freewheeling upon each lateral shaft 30, engages each single impeller bevel gear 34, holding it fast against each tertiary bevel gear 32 so as to prevent inadvertent slippage of their interlocking teeth.

In the transmission 16, some of the individual gears are joined to their respective supporting shafts for rotation therewith, while others are of the freewheeling type. Each of the primary, secondary, tertiary, and impeller bevel gears 26, 28, 32 and 34 are securely fastened to their respective supporting shafts for rotation therewith. Secure fastening may be accomplished by set screws (not shown) machined into each gear, and allowing easy replacement when necessary, or any other suitable mechanism. On the other hand, each guide bevel gear 38 freely rotates upon a supporting lateral shaft 30, its direction of rotation upon the shaft 30 always being opposite to that of secondary bevel gear 28. The guide bevel gears 38 may be provided with internal bearings (not shown) to reduce frictional forces during rotation as well as prevent longitudinal motion of the gear 38 upon the lateral shaft 30.

The impellers 12 and 14 are each fixed upon an impeller shaft 36 for rotation therewith. Each impeller has a number of short fins 40 with spiral contours extending outwardly from a central hub 41, providing a relatively long pitch for driving a stream of water at high velocity. As the dual impeller shafts 36 are always rotated by the transmission 16 in an opposing sense, i.e., one clockwise and one counterclockwise, the spiral contours of the impeller fins 40 on impellers 12 and 14 accordingly oppose one another. Thus, impeller 12 is essentially a virtual mirror image of impeller 14 in FIG. 1. So configured, the impellers 12 and 14 will always simultaneously propel a full stream of water in either a forward or rearward direction when rotated.

The housing 18 comprises a pair of laterally-spaced lobes 42 joined together by an integral, bridge portion 44 which is secured to the bottom of the tubular support 20. Each of the lobes 42 surrounds and enshrouds a single impeller in a streamlined enclosure for reduced frictional resistance when moved through the water. Each lobe 42, thus, tapers from a wide parabolic nose 46 that is pointed forward in the usual direction of travel through the water to a narrow and conically-shaped tail 48 which terminates at a rearwardly-directed discharge opening or nozzle 50. As may best be seen in FIG. 2, the housing 18 is formed by the connection of top and bottom portions 52 and 54 of similar shape along their respective peripheral edges 56 which bisect the housing 18 along a horizontal plane. As the housing 18 is preferably formed from a rigid, thermoplastic material, the connection of the top and bottom portions 52 and 54 is best accomplished with threaded fasteners (not shown) or a water-insoluble adhesive well known in the art.

Figure 2:
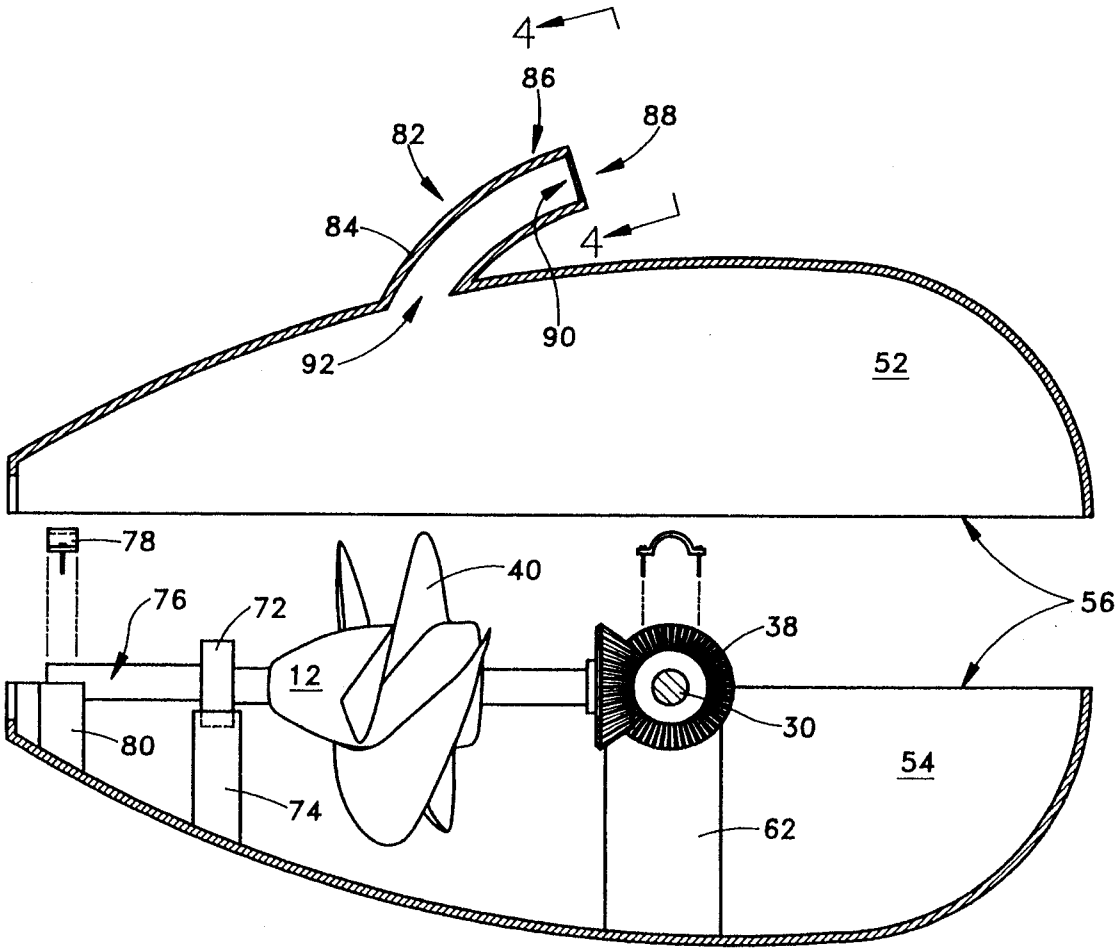
FIG. 2 is a cross-sectional view of the marine propulsion mechanism taken along line 2—2 of FIG. 1.
Figure 4:
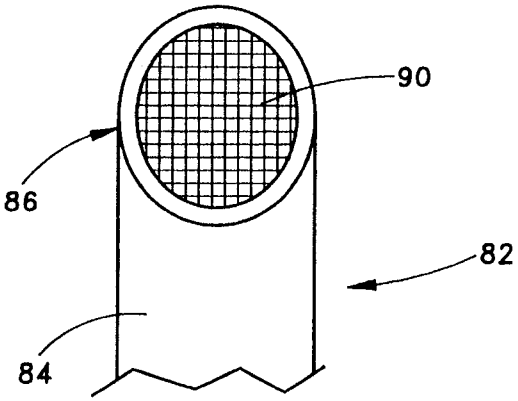
FIG. 4 is a detail view of the inlet scoop as seen from line 4—4 of FIG. 2.

The lateral and impeller shafts 30 and 36 are supported at a fixed distance from the inner wall 58 of the housing 18. Each lateral shaft 30 is rotatably secured in a horizontal plane by two ball bearings 60 of well-known construction which have been joined to the top of rigid supports or risers 62 extending upwardly from the housing bottom portion 54 (FIG. 2). The bearings 60 may be secured to the risers 62 by any suitable method. However, well-known and waterproof adhesive cements are preferred. The outer ends 64 of the shafts 30 are secured by C-shaped clamps 66 to the tops of risers 68 by threaded fasteners 70. Each of the impeller shafts 36 is secured for rotation in the same horizontal plane by a single ball bearing 72 joined to the top of a riser 74 at the rear of the bottom portion 54. Additional ball bearings may, of course, be provided for the shafts to reduce friction and allow the transmission to run more smoothly. The rearward end 76 of each impeller shaft 36 is secured by a C-shaped clamp 78 to riser 80. The risers 62, 68, 74, and 80 are, preferably, integrally molded with the bottom portion 54 from a high-strength, thermoplastic material for long life. Nevertheless, all of the risers may be subsequently joined to the bottom portion 54 after their remote fabrication.

Figure 3:
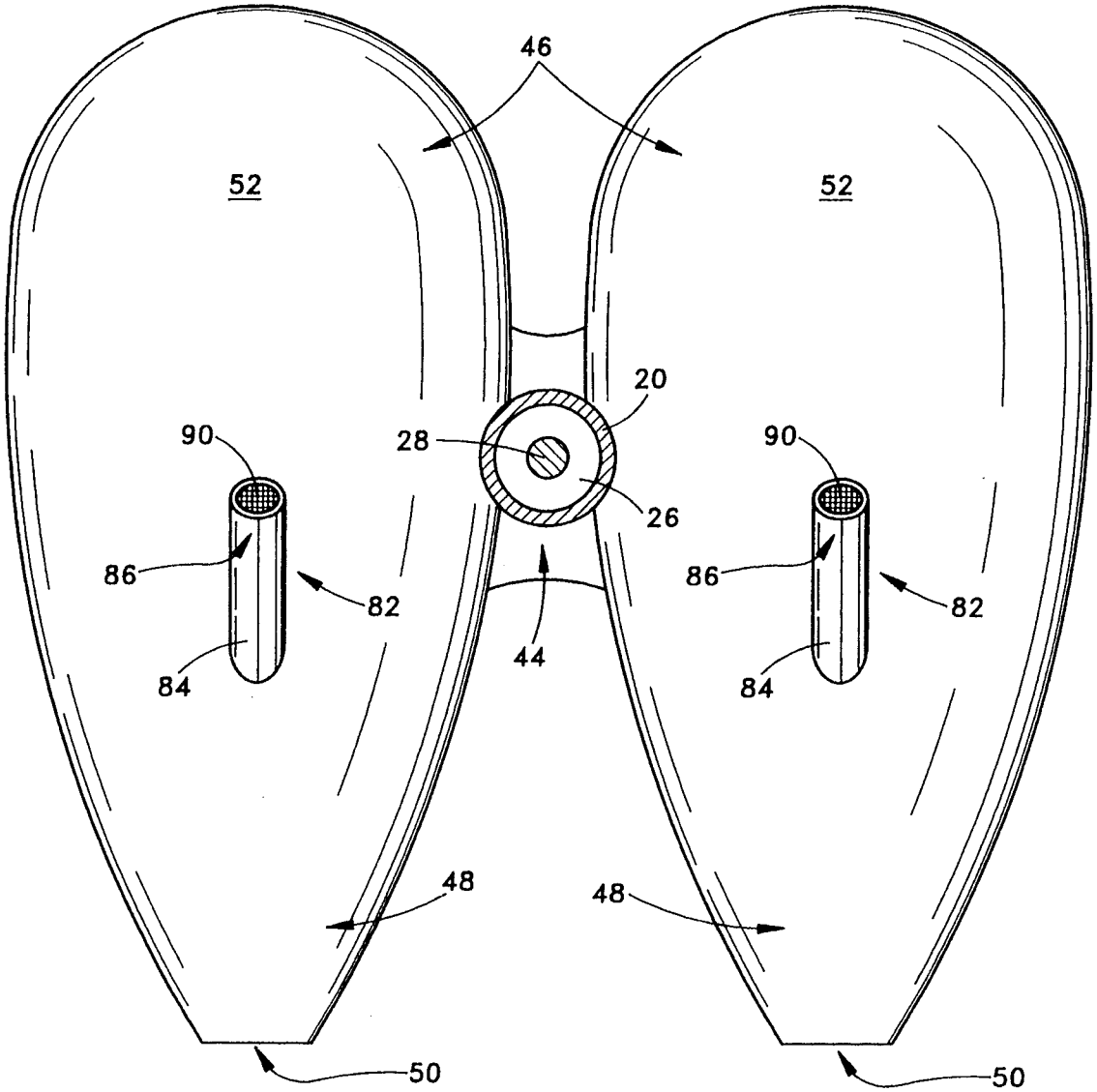
FIG. 3 is a top view of the marine propulsion mechanism showing the top portion and inlet scoops.

As illustrated in FIGS. 2 and 3, a water inlet scoop 82 extends outwardly from the upper surface of each housing lobe 42. Each inlet scoop 82 includes a forwardly curving, rigid, and C-shaped tube 84 in fluid communication with the housing interior. The tube 84 has, at its free end 86, a forwardly directed duct 88 for receiving water from the area adjacent the housing 18. A removable fine mesh screen 90 is fitted within the inlet duct 88 for preventing the entry of particulate matter into the housing 18. The tube 84 is secured about fluid inlet opening 92, in the top portion 52, which is positioned directly above the impeller. By supplying a flow of water to the impeller through the inlet openings 92 at an angle normal to the axis of rotation of the impeller and essentially parallel to the spiral fins 40, it is believed that an area of increased pressure upon the fins is created which provides increased "bite" for the impellers as they are rotated. Thus, the adverse effects of cavitation are reduced and the operational efficiency of the marine propulsion mechanism 10 is increased by the disclosed discharge arrangement.

Figure 6:
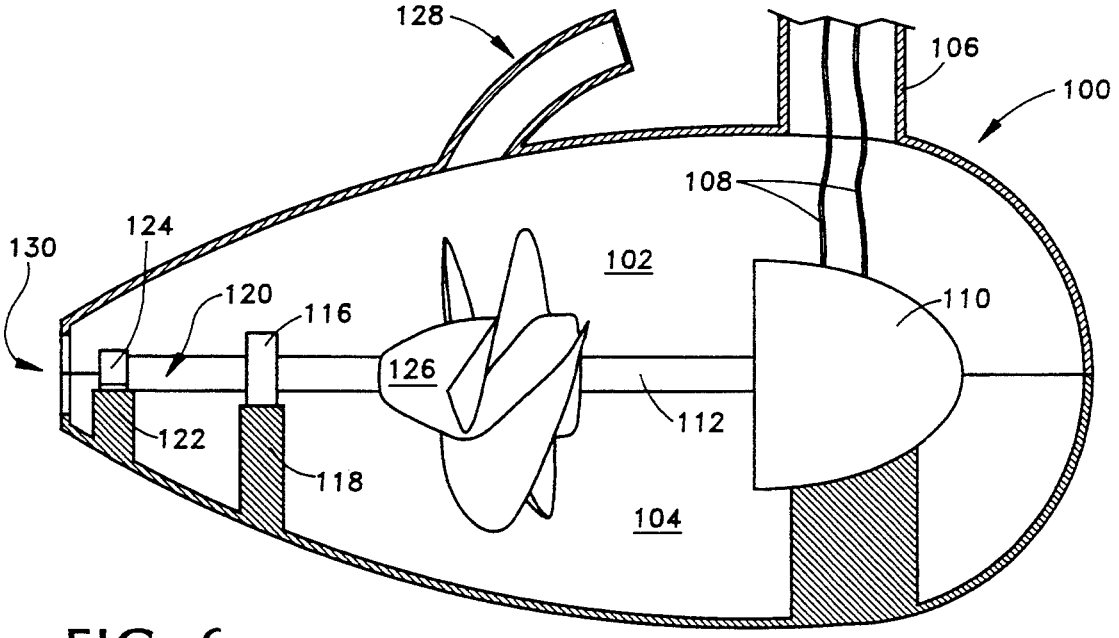
FIG. 6 is a cross-sectional view of a second embodiment of the marine propulsion mechanism taken along a vertical plane bisecting the housing.
Figure 7:
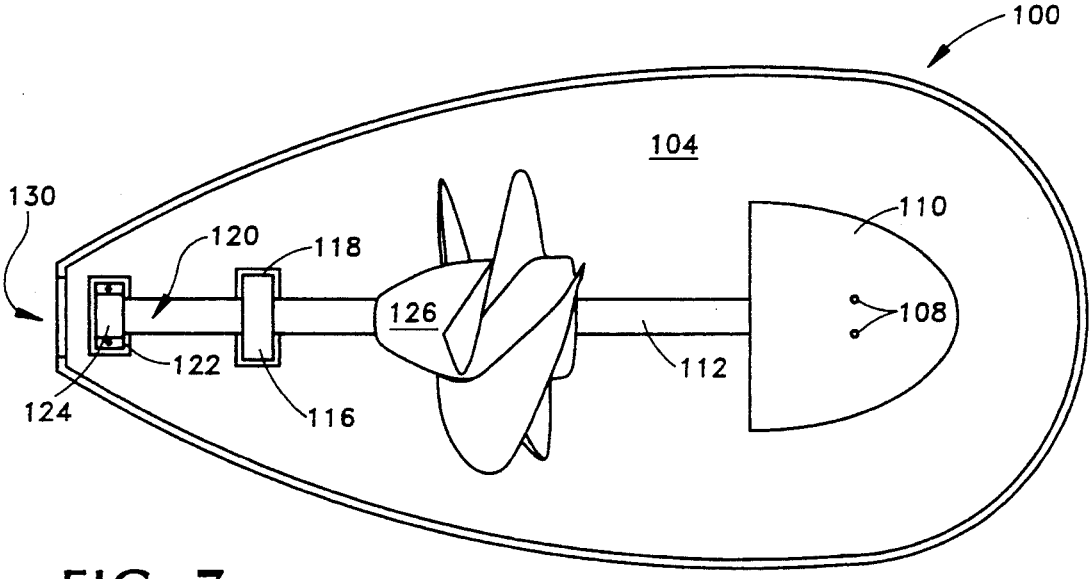
FIG. 7 is a top plan view of the marine propulsion mechanism of FIG. 6, the top portion of the housing having been removed to reveal interior details; and Similar reference characters denote corresponding features consistently throughout the accompanying drawings.

A second embodiment of the invention is illustrated in FIGS. 6 and 7. This particular embodiment includes a single housing lobe 100 assembled from similarly-shaped top and bottom portions 102 and 104. In use, the lobe 100 is suspended beneath the water's surface at the aft end of a boat (not shown) by a tubular support 106. The tubular support 106 may be pivoted about its longitudinal axis by the operator for directional control purposes as in the first embodiment. Electrical wires 108 pass through the support and operatively connect the motor unit 110 to a suitable power supply as, for example, one or more conventional, lead-acid storage batteries (not shown). Operatively positioned between the power supply and the motor unit 110 may be a variable speed electric potentiometer control unit (not shown) which enables the operator to drive the motor unit at any speed desired within the physical limits of the motor unit 110.

An impeller drive shaft 112 extends rearwardly from the motor unit 110 which is joined to the bottom portion by a riser 114. The shaft 112 rotates in a ball bearing 116 joined to the top of a second riser 118 positioned rearwardly of the motor unit 110. The free end 120 of the impeller shaft 112 is secured to the top of a third riser 122 at the rearwardmost end of the bottom portion 104 by a C-shaped clamp 124. An impeller 126 is secured to the shaft 112 between the motor unit 110 and the bearing 116. When normally rotated by motor unit 110, the impeller 126 draws water through the screened (screen is removable) water inlet scoop 128 into the housing 100 and discharges such through the fluid discharge opening or nozzle 130 thereby propelling the water craft forward through the water.

Use of both embodiments of the invention in propelling a water craft through the water is similar, albeit the first embodiment with its dual impellers 12 and 14 is able to produce greater thrust. For movement, each impeller is rotated so as to draw water through the screened inlet scoop and forcefully eject such from the rearwardly disposed discharge opening. Generally, as the rate of rotation of each impeller is increased, the thrust provided by the impeller is increased.

Selective rotation of the impellers in the opposite direction may be accomplished in either embodiment. Such rotation ejects water, drawn into the housing through a discharge opening, from an inlet duct of the inlet scoop and drives the mechanism in reverse.

It is to be understood that the present invention may be embodied in other specific forms and is not limited to the two embodiments described above, but encompasses any and all embodiments within the spirit and scope of the following claims. Therefore, the present embodiments must be considered in all respects as being illustrative only.

I claim:

1. A marine propulsion mechanism submersible in water for driving a water craft, comprising:

a streamlined housing having forward and rearward ends adapted for mounting beneath a water craft, said housing including a fluid inlet opening positioned between said forward and rearward ends and a fluid discharge opening at said rearward end;

an inlet scoop extending outwardly from said housing for directing water to said fluid inlet opening, said inlet scoop further comprising:

a rigid tube having a first end secured about said fluid inlet opening and a second end terminating at a forwardly directed duct remote from said housing; and a screen set within said forwardly directed duct for preventing debris from entering said housing;

a first impeller rotationally secured within said housing adjacent said fluid inlet opening; and first rotary means for rotating said impeller.

2. A marine propulsion mechanism submersible in water for driving a water craft, comprising:

a streamlined housing having forward and rearward ends adapted for mounting beneath a water craft, said housing including a fluid inlet opening positioned between said forward and rearward ends and a fluid discharge opening at said rearward end;

an inlet scoop extending outwardly from said housing for directing water to said fluid inlet opening;

a first impeller rotationally secured within said housing adjacent said fluid inlet opening;

a tubular support joined to said housing for mounting said housing upon a water craft; and first rotary means for rotating said impeller, including a geared transmission comprising:

a vertically disposed drive shaft secured for rotation about its longitudinal axis within said tubular support;

a primary bevel gear secured to the bottom of said drive shaft;

a secondary bevel gear engaged with said primary bevel gear;

a horizontally disposed lateral shaft secured to said secondary bevel gear for rotation therewith;

a tertiary bevel gear fixed upon said lateral shaft, at a distance remote from said secondary bevel gear, for rotation therewith;

an impeller bevel gear engaged with said tertiary bevel gear;

a horizontally disposed impeller shaft secured to said impeller bevel gear for rotation therewith; and said impeller shaft carrying said impeller.

3. The marine propulsion mechanism according to claim 2, further comprising a guide bevel gear freewheeling upon said lateral shaft and engaging said impeller bevel gear for holding said impeller bevel gear fast against said tertiary bevel gear.

4. A marine propulsion mechanism submersible in water for driving a water craft, comprising:

a streamlined housing having forward and rearward ends adapted for mounting beneath a water craft, said housing including a fluid inlet opening positioned between said forward and rearward ends and a fluid discharge opening at said rearward end;

an inlet scoop extending outwardly from said housing for directing water to said fluid inlet opening;

a first impeller rotationally secured within said housing adjacent said fluid inlet opening;

a tubular support joined to said housing for mounting said housing upon a water craft;

first rotary means for rotating said first impeller;

a second impeller rotationally secured within said housing;

second rotary means for rotating said second impeller; and said housing further including:

a pair of laterally spaced lobes joined together by a bridge portion, each said lobe enshrouding one of said impellers;

said fluid inlet in one of said lobes in said inlet scoop extending outwardly from the same lobe;

a second fluid inlet in the other of said lobes;

a second inlet scoop extending outwardly from said other lobe for directing water to said fluid inlet; and said bridge portion being secured to the bottom of said tubular support.

5. The marine propulsion mechanism according to claim 4, wherein said second rotary means for rotating said second impeller includes a geared transmission comprising:

a vertically disposed drive shaft secured for rotation about its longitudinal axis within said tubular support;

a primary bevel gear secured to the bottom of said drive shaft;

a first secondary bevel gear engaged with said primary bevel gear;

a second secondary bevel gear engaged with said primary bevel gear;

a first horizontally disposed lateral shaft secured to said first secondary bevel gear for rotation therewith;

a second horizontally disposed lateral shaft secured to said second secondary bevel gear for rotation therewith;

a first tertiary bevel gear fixed upon said first lateral shaft, at a distance remote from said first secondary bevel gear, for rotation therewith;

a second tertiary bevel gear fixed upon said second lateral shaft, at a distance remote from said second secondary bevel gear, for rotation therewith;

a first impeller bevel gear engaged with said first tertiary bevel gear;

a second impeller bevel gear engaged with said second tertiary bevel gear;

a first horizontally disposed impeller shaft secured to said first impeller bevel gear for rotation therewith and carrying said impeller; and, a second horizontally disposed impeller shaft secured to said second impeller bevel gear for rotation therewith and carrying said second impeller.

6. A marine propulsion mechanism submersible in water for driving a water craft, comprising:

a streamlined housing having forward and rearward ends adapted for mounting upon a water craft, said housing including a fluid inlet opening positioned between said forward and rearward ends and a fluid discharge opening at said rearward end;

a tubular support joined to said housing for mounting said housing upon a water craft;

an inlet scoop extending outwardly from said housing for directing water to said fluid inlet opening, said scoop including a rigid tube having a first end secured about said fluid inlet opening and a second end terminating at forwardly directed duct remote from said housing, said scoop further including a screen set within said forwardly directed duct for preventing debris from entering said housing;

an impeller rotationally secured within said housing adjacent said fluid inlet opening; and an electric motor unit positioned within said housing and having an impeller shaft extending rearwardly therefrom for carrying said impeller.

7. A marine propulsion mechanism submersible in water for driving a water craft, comprising:

a streamlined housing adapted for mounting upon a water craft, said housing including a pair of laterally spaced lobes joined together by a bridge portion, each of said lobes having a forward and a rearward end and a fluid inlet opening positioned therebetween, each of said lobes also having a fluid discharge opening at said rearward end;

a tubular support joined to said bridge portion for mounting said housing upon a water craft;

an inlet scoop extending outwardly from each of said lobes for directing water to one said fluid inlet opening, each said scoop including a rigid tube having a first end secured about one of said fluid inlet openings and a second end terminating at forwardly directed duct remote from said housing and a screen set within said forwardly directed duct for preventing debris from entering said housing;

a pair of impellers, one of said pair of impellers being rotationally secured within each of said lobes adjacent said fluid inlet opening; and a geared transmission disposed within said housing for rotating said pair of impellers.

* * * * *